US009883314B2

(12) United States Patent
Gunawan et al.

(10) Patent No.: US 9,883,314 B2
(45) Date of Patent: Jan. 30, 2018

(54) AUXILIARY AUGMENTATION OF SOUNDFIELDS

(71) Applicant: Dolby Laboratories Licensing Corporation, San Francisco, CA (US)

(72) Inventors: David Gunawan, Sydney (AU); Glenn N. Dickins, Como (AU); Richard J. Cartwright, Killara (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/323,724

(22) PCT Filed: Jul. 1, 2015

(86) PCT No.: PCT/US2015/038866
§ 371 (c)(1),
(2) Date: Jan. 3, 2017

(87) PCT Pub. No.: WO2016/004225
PCT Pub. Date: Jan. 7, 2016

(65) Prior Publication Data

US 2017/0164133 A1 Jun. 8, 2017

Related U.S. Application Data

(60) Provisional application No. 62/020,702, filed on Jul. 3, 2014.

(51) Int. Cl.
*H04S 7/00* (2006.01)
*H04S 3/00* (2006.01)

(52) U.S. Cl.
CPC ..... *H04S 7/30* (2013.01); *H04S 3/002* (2013.01); *H04S 2400/11* (2013.01)

(58) Field of Classification Search
CPC ..... H04S 3/00; H04S 7/304; H04S 2420/11; H04S 2420/01; H04R 3/00; H04R 3/12
(Continued)

(56) References Cited

U.S. PATENT DOCUMENTS 6,259,795 B1 * 7/2001 McGrath ..... H04S 7/304 381/18
6,628,787 B1 9/2003 McGrath
(Continued)

FOREIGN PATENT DOCUMENTS

WO 2010/125228 11/2010
WO 2013/171083 11/2013

OTHER PUBLICATIONS

Hoshuyama, O. et al "A Robust Adaptive Beamformer for Microphone Arrays with a Blocking Matrix Using Constrained Adaptive Filters" IEEE Transactions on Signal Processing, vol. 47, Issue 10, pp. 2677-2684, Oct. 1999.
(Continued)

*Primary Examiner* — Melur Ramakrishnaiah

(57) ABSTRACT

A method for altering an audio signal of interest in a multi-channel soundfield representation of an audio environment, the method including the steps of: (a) extracting the signal of interest from the soundfield representation; (b) determining a residual soundfield signal; (c) inputting a further associated audio signal, which is associated with the signal of interest; (d) transforming the associated audio signal into a corresponding associated soundfield signal compatable with the residual soundfield; and (e) combining the residual soundfield signal with the associated soundfield signal to produce an output soundfield signal.

9 Claims, 4 Drawing Sheets

(58) Field of Classification Search
USPC ..... 381/19, 18, 310, 311; 704/228
See application file for complete search history.

(56) References Cited

U.S. PATENT DOCUMENTS

| | | | |
|---|---|---|---|
| 8,199,942 | B2 | 6/2012 | Mao |
| 8,582,783 | B2 | 11/2013 | McGrath |
| 2009/0116652 | A1 | 5/2009 | Kirkeby |
| 2009/0279715 | A1 | 11/2009 | Jeong |
| 2010/0131269 | A1 | 5/2010 | Park |
| 2010/0202628 | A1 | 8/2010 | Meyer |
| 2011/0142252 | A1 | 6/2011 | Morito |
| 2011/0249825 | A1 | 10/2011 | Ise |
| 2011/0305346 | A1 | 12/2011 | Daubigny |
| 2012/0076316 | A1 | 3/2012 | Zhu |
| 2012/0128160 | A1 | 5/2012 | Kim |
| 2012/0215530 | A1 | 8/2012 | Harsch |
| 2012/0287303 | A1 | 11/2012 | Umeda |
| 2013/0013304 | A1 | 1/2013 | Murthy |
| 2013/0272526 | A1 | 10/2013 | Walther |

OTHER PUBLICATIONS

Haas, Helmut "The Influence of a Single Echo on the Audibility of Speech" JAES vol. 20, Issue 2, pp. 146-159, Mar. 1, 1972.
Loizou, Philipos C. "Speech Enhancement: Theory and Practice", second Edition, 2013.
Hartmann, C. et al "A Hybrid Acquisition Approach for the Recording of Object-Based Audio Scenes" Jul. 9, 2012, 1st Romeo Workshop, Athens Greece, pp. 1-12.

* cited by examiner

AUXILIARY AUGMENTATION OF SOUNDFIELDS

CROSS-REFERENCE TO RELATED APPLICATIONS

This application claims the benefit of priority to U.S. Provisional Patent Application No. 62/020,702 filed 3 Jul. 2014, which is hereby incorporated by reference in its entirety.

TECHNICAL FIELD

The present invention relates to the field of audio soundfield processing and, in particular the augmentation of a soundfield with multiple others spatially separated audio feeds.

BACKGROUND

Any discussion of the background art throughout the specification should in no way be considered as an admission that such art is widely known or forms part of common general knowledge in the field.

Multiple microphones have long been used to capture acoustic scenes. Whilst they are often considered independent audio streams, there has also been the concept of capturing a soundfield using multiple microphones. Soundfield capture in particular is normally an arrangement of microphones which aim to isotropically capture an acoustic scene.

Often, when an audio environment is captured, a number of ancillary audio streams (e.g. lapel microphones, desktop microphone, other installed microphones etc) may also be captured. Often these ancillary sources are considered separate.

Unfortunately, the specific nature of the soundfield capture setup does not lend itself to the trivial integration of ancillary auxiliary microphones sources whilst managing a plausible and perceptually continuous later experience of such a soundfield. It would be advantageous to have a method for the integration of auxiliary microphones into soundfield captures.

SUMMARY OF THE INVENTION

In accordance with a first aspect of the present invention, there is provided a method for altering an audio signal of interest in a multi-channel soundfield representation of an audio environment, the method including the steps of: (a) extracting a first component primarily comprised of the signal of interest from the soundfield representation; (b) determining a residual soundfield signal; (c) inputting a further associated audio signal, which is associated with the signal of interest; (d) transforming the associated audio signal into a corresponding associated soundfield signal compatible with the residual soundfield; and (e) combining the residual soundfield signal with the associated soundfield signal to produce an output soundfield signal.

In some embodiments, the method also includes the step of delaying the residual soundfield signal relative to the associated soundfield signal before the combining step (e). In some embodiments, the step (a) further preferably can include isolating the components of any residual soundfield signal in the signal of interest by utilizing an adaptive filter that minimizes the perceived presence of the residual soundfield in the signal of interest.

In some embodiments, the step (b) further preferably can include isolating the components of the signal of interest in the residual soundfield utilizing an adaptive filter that minimizes the perceived presence of the signal of interest in the residual soundfield signal. In some embodiments, the step (d) further can include applying a spatial transformation to the associated audio signal. The audio content of the signal of interest can be substantially the same as the associated audio signal. The step (d) further can include applying gain or equalization to the associated audio signal.

The multi channel soundfield representation of an audio environment can be acquired from an external environment and the associated audio signal can be acquired substantially simultaneously from the external environment. The soundfield can include a first order horizontal B-format representation.

In some embodiments, the step (a) can include extracting a signal of interest from a predetermined angle in the soundfield representation and the step (d) further can comprise the step of panning the associated audio signal so that it can be perceived to arrive from a new angle.

In accordance with a further aspect of the present invention, there is provided an audio processing system for alteration of an audio signal of interest in a multi-channel soundfield representation, the system including: a first input unit for receiving a multi-channel soundfield representation of an audio environment; an audio extraction unit for extracting a signal of interest from the multi-channel sound field representation and providing a residual soundfield signal; a second input unit for receiving at least one associated audio signal for incorporation into the multi-channel soundfield representation; a transform unit for transforming the associated audio signal into a corresponding associated soundfield signal; a combining unit for combining the associated soundfield signal with the residual soundfield signal to produce an output soundfield signal.

The system can also include a delay unit for delaying the residual soundfield signal relative to the associated sound field signal before combining by the combining unit.

In some embodiments, the system includes an adaptive filter for isolating any signal of interest in the residual soundfield signal. The transform unit further can comprise an associated audio signal rotation unit for rotating the associated soundfield signal. In some embodiments, the system can also include a gain unit for adding a gain or equalization to the associated audio signal.

BRIEF DESCRIPTION OF THE DRAWINGS

Embodiments of the invention will now be described, by way of example only, with reference to the accompanying drawings in which.

DESCRIPTION

Embodiments of the invention deal with multichannel soundfield processing. In such processing, a soundfield is captured using a microphone array and stored, transmitted or otherwise used by a recording or telecommunications system. In such a system, it would be often useful to integrate auxiliary microphone sources into the soundfield either from a lapel microphone from a presenter, from a satellite microphone further down the room, or from additional spot microphones on a football field. Integration of auxiliary signals can provide improved clarity and inclusion of certain objects and events into the single audio scene desired of the target soundfield. The embodiments provide a means for incorporating these and other associated audio streams, while minimally affecting sound from other sources and retaining appropriately the acoustic characteristics and presence of the captured environment. Hence, embodiments provide a soundfield processing system which integrates auxiliary microphones into a soundfield.

In such a system, it is often useful to be able to manipulate a soundfield to move a particular sound source, typically a human talker. Alternatively, it may be useful to isolate speech from a particular talker and replace it with another signal, for example, a lapel microphone feed from the same talker. The illustrative examples provide a means for performing these and other associated tasks, while minimally affecting sound from other sources and retaining appropriately the acoustic characteristics and presence of the captured room.

The embodiments use a beamforming type approach to isolate, from a soundfield, a signal of interest incident from a certain angle, or range of angles, to produce a residual soundfield with that signal partially or wholly removed, add or process audio to create a related signal of interest and then recombine the related signal of interest with the residual using an appropriate precedence delay to produce the output soundfield. An important distinction to prior art is the extent to which the embodiments present a method of removing and manipulating a sufficient amount of signal in order to create the desired perceptual effect, without excessive processing that would otherwise generally introduce unnatural distortion. In contrast to work on blind source separation and independent component analysis (known to those in the art), the embodiments utilizes a balance of signal transformation, adaptive filtering and/or perceptually guided signal recombination to achieve a suitable plausible soundfield.

It has been surprisingly found that avoiding unexpected or unnatural distortions in such processing is of higher priority than achieving a degree of numerical or complete signal separation. In this way, the present invention is tangential to much prior art which focuses on the goal of improved signal separation.

Figure 1:
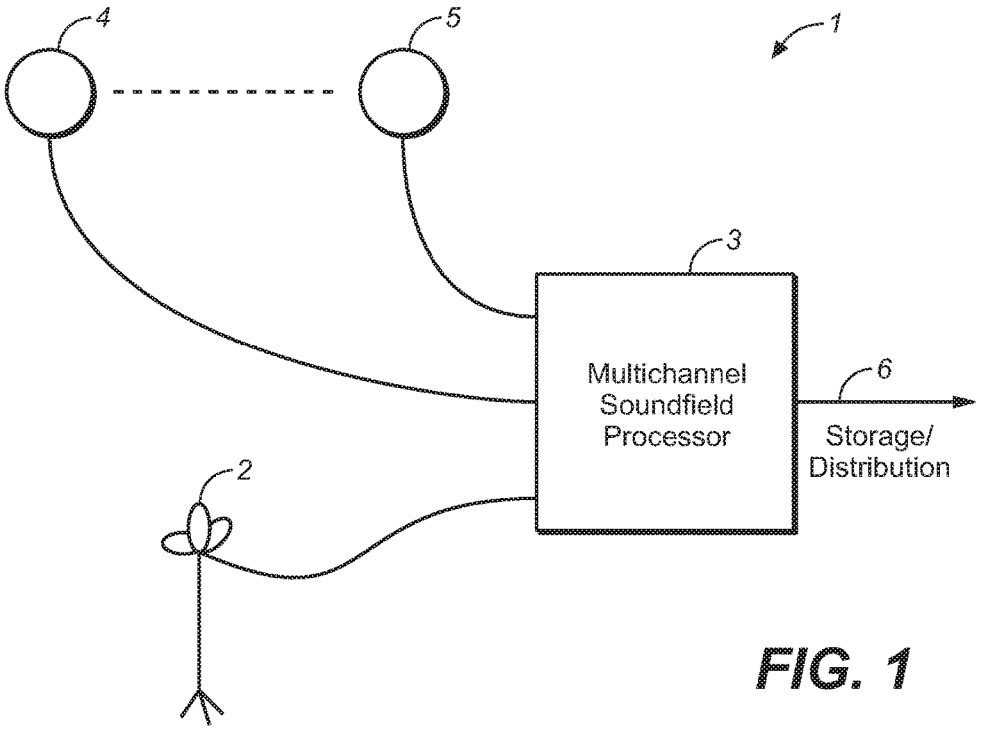
FIG. 1 illustrates schematically and example soundfield recording environment.

FIG. 1 illustrates schematically the operational context of an embodiment. In this example, a soundfield microphone 2 captures a soundfield format signal and forwards it to a multichannel soundfield processor 3. The soundfield signal consists of a microphone array input which has been transformed into an isotropic orthogonal compact soundfield format S. A series of auxiliary microphone signals from microphones $A_1$ to $A_n$ (4,5) are also forward to multichannel soundfield processor for integration into the soundfield S to create a modified soundfield S' for output 6 of the same format as S.

The goal of the invention is to decompose of the soundfield S, such that an auxiliary microphones $A_1$ to $A_n$ may be mixed in into S to form a modified soundfield that incorporates the characteristics of the auxiliary microphone, while retaining the perceptual integrity of the original soundfield S. The simultaneous goal is to ensure that components of signal related to $A_1$ or $A_n$ that may already be in the original soundfield S are suitably managed to avoid creating conflicting or undesirable perceptual cues.

Figure 2:
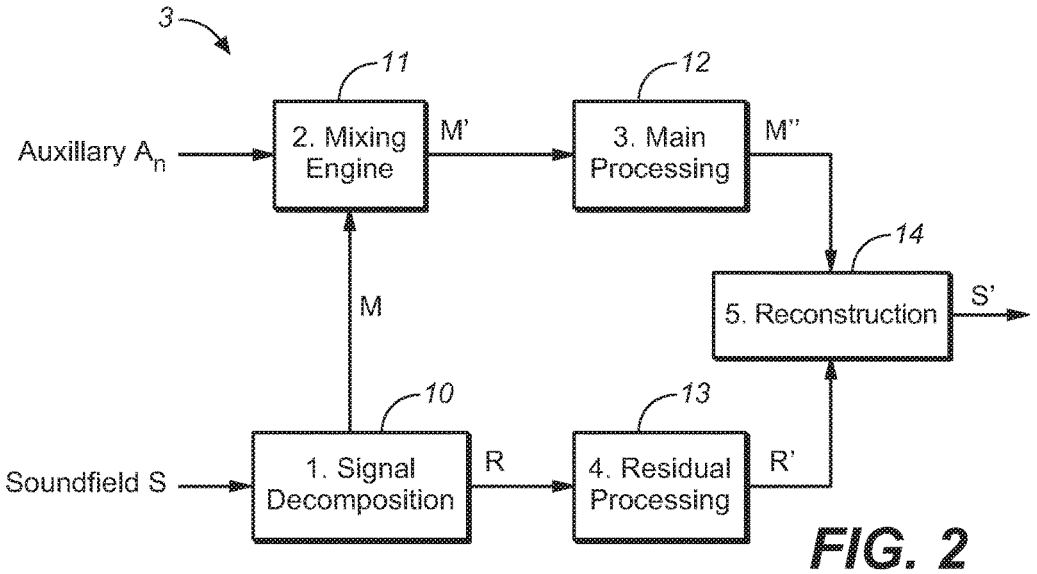
FIG. 2 illustrates an initial arrangement for soundfield processing.

Turning now to FIG. 2, there is illustrated one form of the multichannel soundfield processor 3 which includes a number of subunits for dealing with the input audio streams. The stages or subunits include soundfield signal decomposition 10, mixing engine 11, main processing 12, residual processing 13 and reconstruction 14.

1. Signal Decomposition 10

The signal decomposition unit 10 determines a suitable decomposition for soundfield S by determining a main component M and a residual component R. M describes a signal of interest in the soundfield such as a dominant talker, while R contains the residual soundfield which may contain the reverberant characteristics of the room, or background talkers. Extraction of these components may consist of any suitable processing including linear beamforming, adaptive beamforming and/or spectral subtraction. Many techniques for signal extraction are well known to those skilled in the art. An example goal of the main extractor would be to extract all sound related to a desired object and incident from a narrow range of angles. The main component M is forwarded to mixing engine 11 with the residual R going to residual processing unit 13.

2. Mixing Engine 11

The main component M and each auxiliary component $A_n$ are combined in the Mixing Engine which has the goal of determining when to mix and how to mix the signals together. Mixing at all times has the negative impact of increasing the inherent noise of the system and an intelligent system capable of determining the appropriate time to mix the signals is necessary. Additionally, the proportion to which $A_n$ ought to be mixed in requires a perceptual understanding of the characteristics of the soundfield. For example, if the soundfield S is highly reverberant, and the auxillary microphone $A_n$ is less reverberant, the substitution of the auxillary microphone $A_n$ in place of the main component M would sound perceptually incoherent when recombined with R. The mixing engine 11 determines when to mix these signals, and how to mix them together. How they are mixed involves a consideration of levels and apparent noise floor to maximize perceptual coherence of the soundfield.

3. Main Component Processing 12

The result from the mixing engine 11 M' is then fed into additional main processing unit 12 which applies equalization, reverb suppression or other signal processing.

4. Residual Component Processing 13

The residual component R may also be processed further in a manner that perceptually enhances M and yet still preserves the perceived integrity of the complete soundfield. It is often desirable to remove as much of the signal of interest from R, and this can be aided with the use of generalized sidelobe cancellers and residual lobe cancellers. For example, reference is made to the techniques of signal selection and blocking as set out in a seminal work "A robust adaptive beamformer for microphone arrays with a blocking matrix using constrained adaptive filters", Hoshuyama, O; Sugiyama, A.; Hirano, A. IEEE Transactions on Signal Processing, Volume: 47 Issue: 10 Page(s): 2677-2684

Additionally, to improve the perception of the main component M, various psychoacoustics effects can be incorporated to further perceptually suppress the perceptual impact of the residual. One such effect is the Hass effect denoted as "Precedence Delay" (Haas, H. "The Influence of a Single Echo on the Audibility of Speech", JAES Volume 20 Issue 2 pp. 146-159; March 1972).

When the same sound signal is played back to a listener from two different directions and one of the sources has a short delay, Haas showed that the source that is first received at the ears dominates the listener's perceived direction of arrival. Specifically, Haas taught that source A would be perceived as having the dominant incident angle even if source B, playing the same content delayed by a short time in the range of 1-30 ms, was up to 10 dB louder than A. The Precedence Delay delays the residual components of the soundfield. This ensures that the main component is presented to a listener before the residual component with the goal that the listener perceives the main signal, by virtue of the precedence effect, as coming from a desired location. The Precedence Delay may be integrated into the Signal Decomposition (11). The precedence delay may be introduced to delay the residual processing in (13) to create R'. More broadly, the management of the delay in the signal processing paths should be managed such that the introduced and rendered version of M" occurs in the output soundfield S' substantially (1-30 ms) ahead of any correlated or related signal occurring in the residual path R'.

While it is possible that the residual components are represented in same format as S, the residual soundfield components may optionally be constructed to contain less information than the input soundfield (since the signal of interest has been removed or suppressed). One motivation for using a different representation for the residual components is that it may be cheaper to apply Precedence Delay to R when it has fewer channels than S.

5. Reconstruction 14

Once M" and R' have been determined, the modified soundfield can be reconstructed. The reconstruction of the soundfield can include other additional operations such as panning of the main component M", or a rotation of the soundfield.

Specific Embodiments

In one embodiment of the present invention, the format used for S is a first-order horizontal B-format soundfield signal (W, X, Y) and produces as output a modified signal (W', X' Y').

The embodiment aims to integrate one or more auxillary microphones $A_n$ into the soundfield S, where $A_n$ is positioned at an angle φ relative to S, and the directionality pattern of $A_n$ is a cardioid.

1. Signal Decomposition 10

Figure 3:
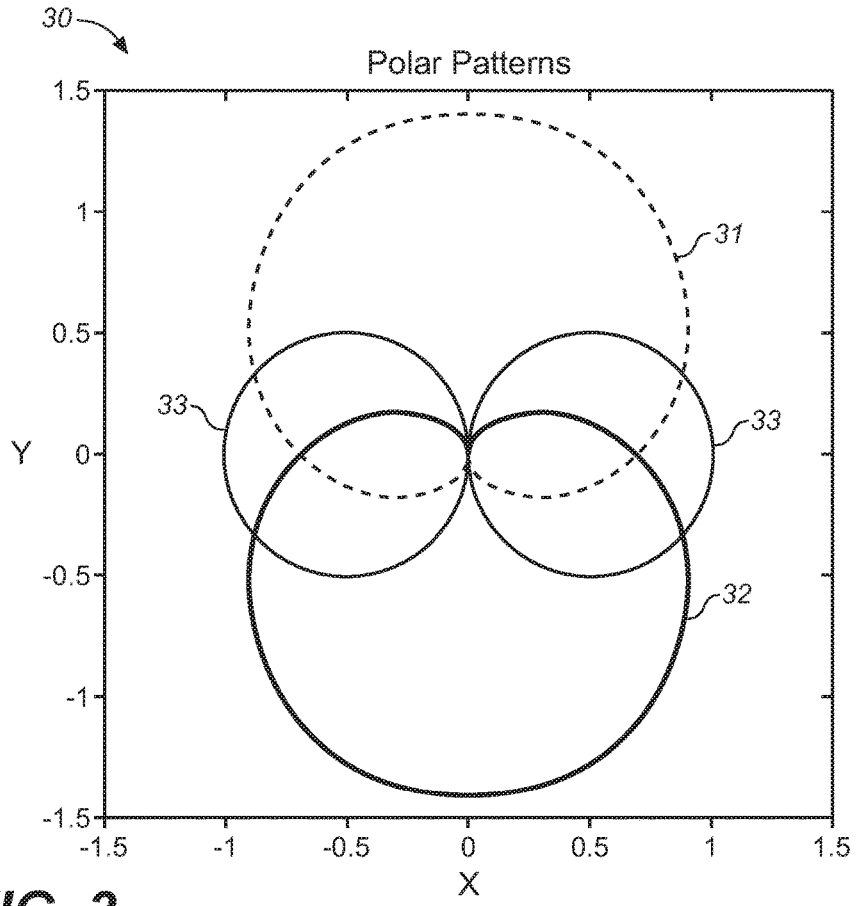
FIG. 3 illustrates a plot of the polar responses of the main components and the residual components.

The soundfield signal $S=[W\ X\ Y]^T$ can be decomposed into a main component M and a residual component in a variety of ways including an orthonormal linear matrix or a set of adaptive filters (e.g. generalized sidelobe canceller). In this embodiment, an orthonormal linear matrix can be used:

$$\begin{bmatrix} M \\ R_1 \\ R_2 \end{bmatrix} = D \begin{bmatrix} W \\ X \\ Y \end{bmatrix}$$

where $$D = \begin{bmatrix} 0.5 & 0.5\cos\varphi & 0.5\sin\varphi \\ 0.5 & 0.5\cos(\varphi-\pi) & 0.5\sin(\varphi-\pi) \\ 0 & \cos\left(\varphi-\frac{\pi}{2}\right) & \sin\left(\varphi-\frac{\pi}{2}\right) \end{bmatrix}$$

where φ is the positional angle of the auxillary microphone $A_n$ relative to S. This creates a number of components as illustrated in FIG. 3, with a main component M 31 with a cardioid directionality pattern in the direction of φ, with 2 residual components $R_1$ 32 (a cardioid 180 degrees from M) and $R_2$ 33 (a figure of 8 pattern with the null pointing in the direction of φ).

In the simplest case, where the angle is fixed relative to S, φ is trivially determined, however if this is not the case, then φ may be calculated online in a real time system using the statistical modeling of objects. In one embodiment:

$$\varphi = \sum_{p=0}^{P} \theta_p / P$$

Alternatively, a circular mean of the angles can be taken:

$$e^{i\varphi} = \sum_{p=0}^{P-1} w_p e^{\theta_p} / \sum w_p$$

where θ is the angle of an audio objects in the acoustic scene and p is the set of all audio objects whose instantaneous SNR at auxillary microphone $A_n$ is greater than the instantaneous SNR at S.

In such a system, a component of inference and estimation may be operating in order to monitor the activity and approximate angles of sound objects that have been observed in some recent history of the device. Identification of the direction of arrival of sources from an array of sensors is well known in the art. The statistical inference and maintenance of objects and/or target tracking is also well known. As part of such analysis, the historical information of activity can be used to infer an estimate of angle for given objects.

Where a set of multiple objects may be deemed to be more associated with the auxiliary or extracted signal, some central or mean angle to the set of objects can be selected as the suitable perceptually rendered location of the mixed signal M'. The expression above is taken to be interpreted as the intention to take some weighted mean of a set of angles related to where the objects intended to be placed into the target soundfield S'. Often it is generally the case where such angles related to the objects are derived from estimates of the object angle in the initial soundfield S, where such estimates are obtained using historical information of the soundfield S and statistical inference.

The above operation is repeated for each auxiliary input or audio source.

2. Mixing Engine 11

The Mixing Engine 11 endeavours to fulfill two functions: Determine when to mix in the auxillary microphones; as well as determine how to mix the auxillary microphones into the soundfield.

2.a. Auxiliary Microphone Selection

Knowing when to mix in $A_n$ is important to ensuring that the auxillary microphones do not add excessive noise to the soundfield. Thus selecting when to add them to the soundfield S is critical to minimizing the noise of the system.

Selecting to turn on auxillary microphone $A_n$ can be determined by comparing the instantaneous SNR of $A_n$ compared to the instantaneous SNR of S. The instantaneous SNR is defined as the voice level to noise floor level of the microphone at a particular time instant. If instantaneous SNR is denoted as I, then we select $A_n$ when $$r = \frac{(I_{An} + \alpha)}{(I_{An} + \alpha) + I_s} > t_r$$

where $\alpha$ is allowed to fluctuate depending the number of observations seen where $r > t_r$, and where $t_r$ is a threshold of selectivity. The parameter $\alpha$ decreases with increasing observations, thereby adding hysteresis to the selectivity criterion of $A_n$.

2.b. Auxiliary Microphone Mixing

Once $A_n$ has been selected to be mixed into S, the proportion to which it ought to be mixed in can be governed once again by the instantaneous SNR I. In one embodiment, r can be forced to decay more slowly (using a first order smoothing filter) to emulate the reverb tail of a room and then the mixing function can be given by $$b = \begin{cases} r, & r \geq r[n-1] \\ \tau r + (1-\tau) r[n-1], & r < r[n-1] \end{cases}$$

$$M' = f(b)A_n + (1 - f(b))M$$

where b is the mix parameter and $f(b)$ is a mix function (e.g. linear, logarithmic). The mix function would also limit the minimum and maximum allowable mix to retain perceptual coherence of the soundfield. The mix function $f(b)$ is used to control the characteristics of the mixing transition between the alternate signals M and $A_n$. General requirements are that $f(b)$ has a domain of [0 . . . 1] and a range is monotonic. A simple example of such a function that is useful in one embodiment is $f(b)=0.9*b$ For such a function it is noted that the filtered sense of preferred auxiliary input $A_n$, b, is mapped to a gain range from 0 (elimination) through to close to unity, whilst the signal M is mixed in with no less than −20 dB gain. In some embodiments, an amount of residual for the original signal component in the soundfield is useful for continuity.

More generally, the signal M' may be constructed by a pair of mixing functions $$M' = f(b)A_n + g(b)M$$

Since it may be desirable to control the maximum and minimum gains and mapping functions for the two signals $A_n$ and M.

Alternative embodiments may also preprocess $A_n$ and M to be appropriately leveled and have matching noise floors using standard noise suppression methods. This would assist in the maximization of perceptual coherence between the mixed signals.

3. Main Component Processing 12

The main component M' may be further processed to achieve a desired modification or enhancement of the audio. There are many techniques known to those in the art that may apply to the modification of an audio signal, in particular for the application where the object of interest is voice or a voice like signal. Specific examples of signal processing at this stage may include but are not limited to: equalization, where a frequency dependent filtering is applied to correct or impart a certain timbre to enhance or compensate for distance or other acoustic effects; dynamic range compression, where a time varying gain is applied to change the level and or dynamic range of the signal over one or more frequency bands; signal enhancement, such as speech enhancement where time varying filters are used to enhance intelligibility and/or salient aspects of the desired signal; noise suppression, where a component of the signal, such as stationary noise, is identified and suppressed by way of spectral subtraction; reverb suppression, where the temporal envelope of the signal may be corrected to reduce the effects of reverberant spread and diffusion of the desired signal envelope; and activity detection, where a set of filters, feature extraction and or classification is used to detect threshold or continuous levels of activity for a signal of interest and alter one or more signal processing parameters. For indicative examples, reference is made to the standard texts such as: Speech Enhancement: Theory and Practice, Second Edition [Hardcover] by Philipos C. Loizou.

4. Residual Component Processing 13

Following the signal decomposition (1), an optional set of adaptive filters may be used to minimize the amount of residual signal present in the main component. In one embodiment, a conventional normalised least mean squares (NLMS) adaptive finite impulse response (FIR) filters of impulse response length 2 to 20 ms can be used. Such filters adapt to characterise the acoustic path between the main beam and the residual beams, including room reverberation, thereby minimising the perceived amount of residual signal also heard in the main signal. Similar adaptive filters may be used to minimise the amount of main signal in the residual component.

To make use of the so-called Haas effect or precedence, it is useful to add some delay to the residual component. This delay can be denoted as a Precedence Delay. Such a delay can be added in any place in the system that affects the residual component, but does not affect the main component. This ensures that the first onset of any sound presented to a listener in the output soundfield comes from direction of the main component and maximises the likelihood that the listener perceives the sound from the intended direction.

5. Reconstruction 14

The reconstruction of soundfield then involves the recombination of the main component and the residual components after their associated processing. The reconstruction follows the inverse of the decomposition such that $$S' = \begin{bmatrix} W' \\ X' \\ Y' \end{bmatrix} = D^{-1} \begin{bmatrix} M'' \\ R_1' \\ R_2' \end{bmatrix}$$

where $D^{-1}$ is the inverse of D.

Since the main component and the residual components are reasonably separate, an optional process can include a panning rotation of the main component to a different location in the soundfield. The addition of the Precedence Delay and other residual processing ensures that localization of the main component is perceptually maximized.

Alternative Embodiment

In alternative arrangements, if the system input is captured from a microphone array, it must first be transformed to format S before being presented to the system for processing. Similarly, the output soundfield may need to be transformed from format S to another representation for playback over headphones or loudspeakers.

The residual component representation, denoted R, is used internally. Format R may be identical to format S or may contain less information—in particular, R may have a greater or lesser number of channels than S and is deterministically, though not necessarily linearly, derived from S.

This embodiment extracts the signal of interest (denoted M), or main signal, from the input soundfield and produce an output soundfield in which the signal of interest is perceived to have been moved, altered or replaced, but in which the remainder of the soundfield is perceived to be unmodified.

Figure 4:
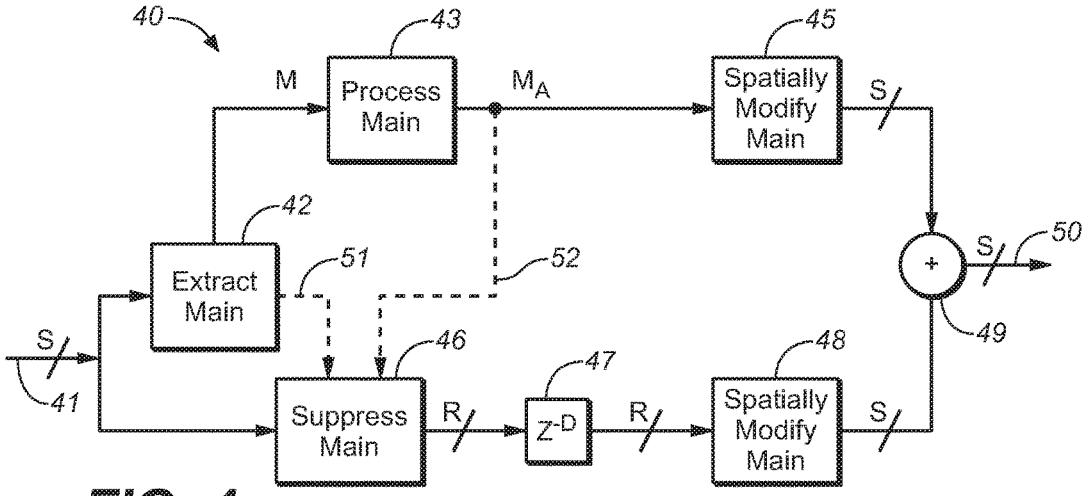
FIG. 4 illustrates an alternative arrangement for soundfield processing.

FIG. 4 illustrates an alternative arrangement 40 of the multichannel soundfield processor (3 of FIG. 1). In this arrangement, a Soundfield input signal 41 is input as a signal derived from a soundfield source (eg. soundfield microphone array) in a format S. A Main signal extractor 42 extracts the signal of interest (M) from the incoming soundfield. A Main signal processor 43 produces the associated signal (MA) using as input one or both of the signal of interest (M) and one or more auxilliary signals (44). The Auxlliary signal input 44, one or more auxiliary signals (eg. a spot microphone signals) are injected here. A Spatial modifier 45 acts on an associated signal (MA) to transform it into a soundfield signal in format S with spatially modified characteristics.

In respect of the main signal, a Main signal suppressor 46 acts to suppresses the signal of interest (M) in the incoming soundfield, producing residual components in format R. A Precedence Deal unit 47 acts to delay the residual components relative to the signal MA. A Residual transformer 48 transforms the delayed residual components back to soundfield format S. A Mixer 49 then combines the modified associated soundfield with the residual soundfield to produce output 50 which is the Soundfield output signal in format S.

The first processing step performed on the input soundfield (41) is to extract the signal of interest (42). The extraction may consist of any suitable processing including linear beamforming, adaptive beamforming and/or spectral subtraction. A goal of the main extractor is to extract all sound related to a desired object and incident from a narrow range of angles.

Also operating on the input soundfield, the main signal suppressor (46) aims to produce a residual component representation of the soundfield that describes, to the maximum extent possible, the remainder of the soundfield with the signal of interest removed. While it is possible that the residual components are represented in format S, similarly to the input soundfield, the residual soundfield components may optionally be constructed to contain less information than the input soundfield (since the signal of interest has been removed or suppressed). One motivation for using a different representation for the residual components is that it may require less processing to apply delay (47) to format R when it has fewer channels than format S.

The main extractor and suppressor can be configured in a variety of topologies as partially shown by the dotted connections 51, 52 in FIG. 4. Example topologies include: The main suppressor uses the signal of interest (M) 51 as a reference input. The main suppressor uses the associated signal (MA) 52 as a reference input. The main extractor uses the residual components as reference input. The main suppressor and extractor are interrelated and share one another's state.

Regardless of the topology of the main extractor relative to the main suppressor, it can be useful for these components to share state and common processing elements. For example, when both the main extractor and the main suppressor perform linear beamforming as part of their processing, the linear beamforming can be coalesced into a single operation. An example of this is given in the preferred embodiment described below.

The main signal processor (43) is responsible for producing the associated signal (MA) based on the signal of interest and/or the auxiliary input (44). Examples of possible functions performed by the main signal processor include: Replacing the signal of interest in the resulting soundfield with a suitable processed auxiliary signal, Applying gain and or equalization to the signal of interest, Combining the suitably processed signal of interest and a suitably processed auxiliary signal.

The spatial modifier (45) produces a soundfield representation of the associated signal. It may take, by way of example, a target angle of incidence, from which the associated signal should perceptually appear to arrive in the output soundfield. Such a parameter would be useful, for example, in an embodiment that attempts to isolate as a signal of interest all sound incident in the input soundfield from a certain angle and make it appear to come instead from a new angle. Such an embodiment is described below. This example is given without loss of generality in that the structure could be used to shift other perceptual properties of the signal of interest in the captured soundfield such as distance, azimuth and elevation, diffusivity, width and movement (Doppler shift).

When the same sound signal is played back to a listener from two different directions and one of the sources has a short delay, Haas showed that the source that is first received at the ears dominates the listener's perceived direction of arrival. Specifically, Haas taught that source A would be perceived as having the dominant incident angle even if source B, playing the same content delayed by a short time in the range of 1-30 ms, was up to 10 dB louder than A. The precedence delay unit (47) delays the residual components of the soundfield. This ensures that the associated soundfield is presented to a listener before the residual soundfield with the goal that the listener perceives the associated signal, by virtue of the precedence effect, as coming from the new angle or location as determined by the spatial modifier (45). The precedence delay (47) may also be integrated into the main suppressor (46). It is noted against the Haas reference that the ratio of the inserted processed or combined signal of interest with the perceptually modified properties is in its first point of arrival achieved or controlled as being 6-10 dB above any residual signal content related to the signal of interest (e.g. later reverberation in the captured space) which is not suppressed in the residual path. This constraint is generally achievable, especially in the case of modifying the signal of interest angle as set out in the preferred embodiment.

Since the residual soundfield components are represented in format R, a transformation component (48) may be required to transform format R back to format S for output. If formats R and S are chosen to be identical in a particular embodiment, the transformation component may be omitted. It should be apparent, that without loss of generality, any transformation, mixdown or upmix process could preceed or follow, as would be required in certain applications to achieve compatibility and suitable use of all available microphones and output channels. Generally, the system would take advantage of as much information and therefore input microphone channels, as were available at the time of processing. As such, variants can be provided that encapsulating the central framework of the arrangement, but having different input and output formats.

The soundfield mixer (49) combines the residual and associated soundfields together to produce a final output soundfield (50).

Figure 5:
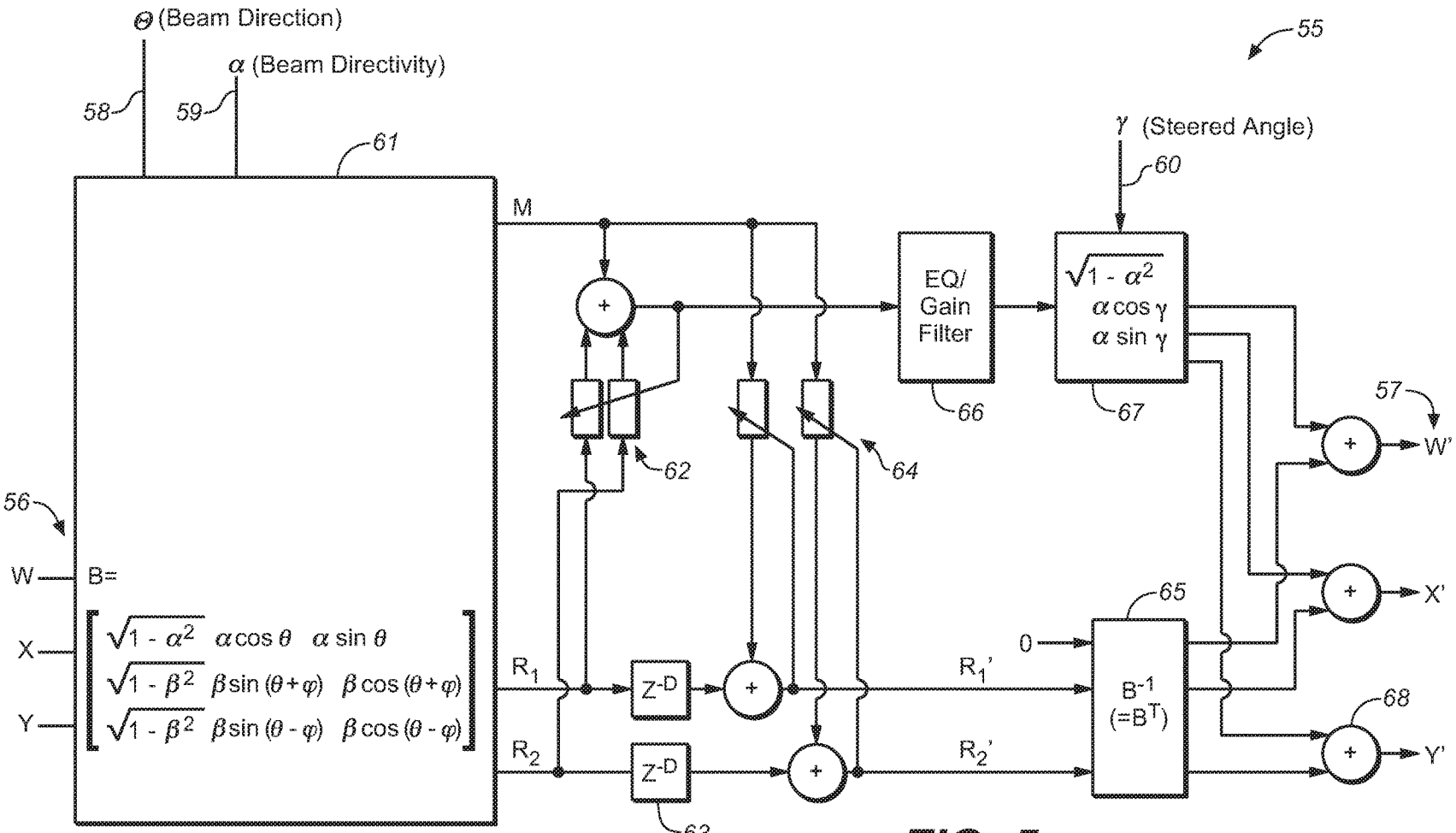
FIG. 5 illustrates a further alternative arrangement for soundfield processing.

One form of sound source repositioning system is shown 55 in FIG. 5 and uses as format S a first-order horizontal B-format soundfield signal (W, X, Y) 56 and produces as output a modified signal (W', X' Y') 57. Whilst the system is designed to process B-Format signals, it would be understood that it is not restricted thereto and would extend to other first order horizontal isotropic basis representation of a spatial wavefield, namely the variation of pressure over space and time represented in a volume around the captured point constrained by the wave equation and linearized response of air to sound waves at typical acoustic intensities. Further, such a representation can be extended to higher orders, and that in first order the representations of B-Format, modal and Taylor series expansion are linearly equivalent.

The embodiment aims to isolate all sound incident from angle θ 58 and produce an output soundfield in which that sound instead appears to come from angle γ 60. The system aims to leave sounds incident from all other angles unaltered. Where the soundfield presented has more than two dimensions, angles θ and γ should be replaced with a suitable multidimensional orientation representation method such as Euler angles (azimuth, elevation etc) or quaternions.

The arrangement 55 includes: a Beamforming/blocking matrix 61 which linearly decomposes the input soundfield into main beam M and residuals R1, R2; a Generalised Sidelobe Canceller (GSC) 62 which adaptively removes residual reverberation from the main beam; a Precedence Delay unit 63 which ensures that direct sound from new direction γ is heard before any residual from direction θ; a Residual Lobe Canceller (RLC) 64 which adaptively removes main reverberation from the residual beams; an Inverse matrix 65 which transforms residuals back to the original soundfield basis; a Gain/Equaliser 66 which compensates for loss of total energy caused by GSC and RLC; a Panner 67 which pans the main beam into soundfield at new angle γ; and Mixer 68 which combines the panned main beam with the residual soundfield.

The first component in the arrangement of FIG. 5 is the beamforming/blocking matrix B 61. This block applies an orthonormal linear matrix transformation such that a main beam M is extracted from the soundfield pointing in the direction θ 58. The transformation also produces a number of residual signals $R_1 \ldots R_N$, which are orthogonal to M as well as being mutually orthogonal (recall that B is orthonormal). These residual signals correspond to format R. The format R can have fewer channels than format S.

In the embodiment 55, the input soundfield (W, X, Y) is transformed into (M, $R_1$, $R_2$) by the equation:

$$\begin{bmatrix} M \\ R_1 \\ R_2 \end{bmatrix} = \begin{bmatrix} \sqrt{1-\alpha^2} & \alpha\cos\theta & \alpha\sin\theta \\ \sqrt{1-\beta^2} & \beta\sin(\theta+\varphi) & \beta\cos(\theta+\varphi) \\ \sqrt{1-\beta^2} & \beta\sin(\theta-\varphi) & \beta\cos(\theta-\varphi) \end{bmatrix} \begin{bmatrix} W \\ X \\ Y \end{bmatrix}$$

In this equation a describes the directionality pattern of the main beam. For example, at $\alpha=1/\sqrt{2}$, the main beam will have a cardioid polar response. At $\alpha=1$, the main beam will have a dipole (figure of eight) response.

Figure 6:
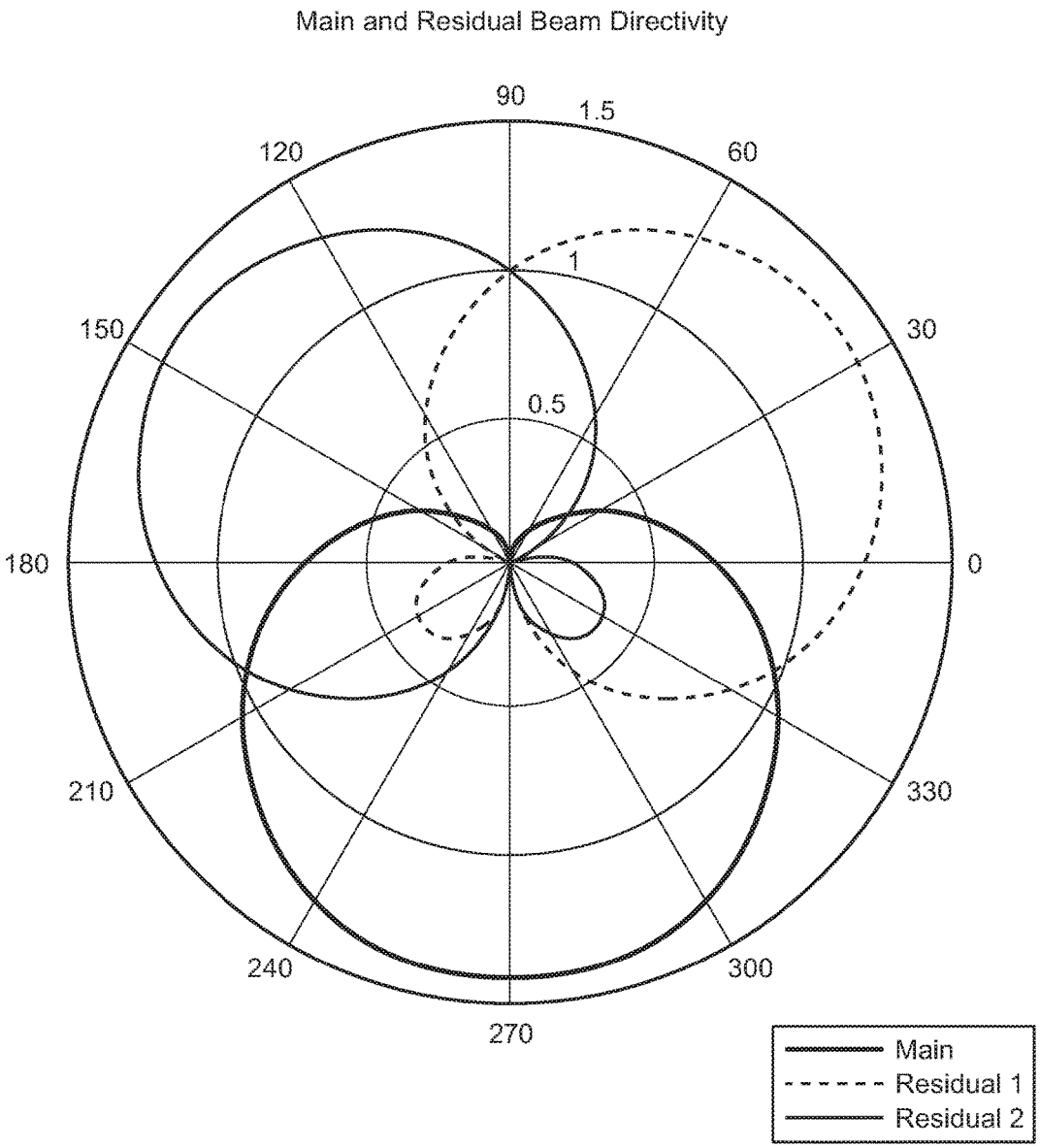
FIG. 6 illustrates an example directivity pattern of main and residual beams utilized in one embodiment of the arrangement of FIG. 5.

The formulation of matrix B used in this preferred embodiment requires that the two residual beams have directionality pattern β(with meaning as for α) and are offset from the main beam by angles ±φ. FIG. 6 illustrates one example of a main 71 and residual beam patterns 72, 73 for the embodiment. Solving for β and φ, given the constraint of B orthonormal, ie $BB^T=I$, gives the following closed-form solution.

$$\beta = \sqrt{1-\frac{\alpha^2}{2}}$$

$$\varphi = \tan^{-1}\left(\frac{(\alpha^2-2)\sqrt{\frac{-1}{\alpha^2-2}}}{\sqrt{2}\sqrt{1-\alpha^2}\sqrt{1-\frac{\alpha^2}{2}}}\right)$$

Returning to FIG. 5, following the beamforming/blocking matrix, an optional set of adaptive filters (62) may be used to minimize the amount of residual signal present in the main signal. A conventional normalised least mean squares (NLMS) adaptive finite impulse response (FIR) filters of impulse response length 2 to 20 ms cam be used. Such filters adapt to characterise the acoustic path between the main beam and the residual beams, including room reverberation, thereby minimising the perceived amount of residual signal also heard in the main signal.

To make use of the so-called Haas effect or precedence effect in the present invention, it is useful to add some delay 63 to the residual signals. Such a delay can be added in any place in the system that affects the residual soundfield, but does not affect the main beam. This ensures that the first onset of any sound presented to a listener in the output soundfield comes from direction γ via the panner 67 and maximises the likelihood that the listener perceives the sound that originally came from direction θ as instead coming from direction γ.

The arrangement 55 further includes adaptive filters 64 designed to minimize the amount of main signal present in the residuals. NLMS adaptive FIR filters with impulse response length 2 to 20 ms are good choices for such filters. By choosing an impulse response length under 20 ms, the effect is to substantially remove any early echos of the main signal present in the residual that contain directional information. This technique can be denoted Residual Lobe Cancellation (RLC). If the RLC filter is successful in removing all directional echos, only the late reverberation will remain. This late reverberation should be largely omnidirectional and would have been similar had the main signal actually originated from direction γ. Thus the resulting soundfield remains useful.

In FIG. 5, the precedence delay 63 is shown before the RLC 64. This has the advantage of encouraging better numerical performance in the RLC when wavefronts arrive through the residual channels ahead of the main channel, which may be possible with certain microphone arrays, source geometries and source frequency content. However, such a placement effectively reduces the useful length of the RLC filters. Therefore, the precedence delay could also be placed after the RLC filters or split into two delay lines with a short delay before the RLC and a longer delay thereafter.

After processing, the residual signals must be transformed back to the original soundfield basis 65 by applying the inverse beamforming/blocking matrix $B^{-1}$. Recall that B was required to be orthonormal, which implies $B^{-1}=B^T$. This transformation is described for the soundfield basis of FIG. 5 by the following equation, in which the first column of $B^T$ may obviously be omitted to avoid some multiplications by zero.

$$\begin{bmatrix} W'_R \\ X'_R \\ Y'_R \end{bmatrix} = B^T \begin{bmatrix} 0 \\ R_1 \\ R_2 \end{bmatrix}$$

Since unit 61 mutually removes the main signal M from the residuals R and the residuals from the main signal, this may have removed nett energy from the soundfield. A gain equalisation block 66 is therefore included to compensate for this lost energy.

After processing the main signal must be transformed back to the original soundfield basis, appearing to arrive from new direction γ, via the panner 67. The panner implements the following transformation for the basis signal:

$$\begin{bmatrix} W'_M \\ X'_M \\ Y'_M \end{bmatrix} = \begin{bmatrix} \sqrt{1-\alpha^2} \\ \alpha\cos\gamma \\ \alpha\sin\gamma \end{bmatrix} M$$

The final step in producing the output soundfield is to recombine the soundfield components due to the main and residual signals. The mixer 68 performs this operation according to the following equation.

$$\begin{bmatrix} W \\ X \\ Y \end{bmatrix} = \begin{bmatrix} W'_M \\ X'_M \\ Y'_M \end{bmatrix} + \begin{bmatrix} W'_R \\ X'_R \\ Y'_R \end{bmatrix}$$

The arrangement 55 therefore implements the soundfield modification of FIG. 4, in the following way: The GSC filters (62) together with the beamforming/blocking matrix (62) embody the main extractor (42) of FIG. 4. The RLC filters (64) together with the beamforming/blocking matrix (62) embody the main suppressor (46) of FIG. 4. In this arrangement, the beamforming/blocking matrix has been shared between the main extractor and main suppressor for efficiency reasons. The EQ/gain block (66) embodies the main processor (43) of FIG. 4. The panner (67) embodies the spatial modifier (45) of FIG. 4. The precedence delay (63) embodies the delay (47) of FIG. 4. The inverse matrix (65) embodies the residual transformer (48) of FIG. 4. The mixer (68) embodies the mixer (49) of FIG. 4.

The arrangement of FIG. 5 therefore provides a specific parameterization, design and identity relationship of the blocking matrix to operate in the horizontal B-Format; the specific purpose and construction of the Residual Lobe Cancellor (RLC); the combination network and stabilization of the RLC and GSC; the use of the delay guided by Haas principle to emphasize the modified spatial properties of the signal of interest whilst retaining residual in the soundfield related to the signal of interest (e.g. some structural acoustic reflections and reverberation); the use of EQ, gain and spatial filtering or rendering to create a modified signal of interest having different perceptual properties to the signal of interest suppressed from the original soundfield; the option for using an auxiliary signal related to the signal of interest to achieve the desired effect, in particular to bring close microphones into a plausible soundfield; the specific application of the above ideas and integration of prior art as required to achieve the outcome of soundfield modification for a teleconferencing application.

Interpretation

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

As used herein, the term "exemplary" is used in the sense of providing examples, as opposed to indicating quality. That is, an "exemplary embodiment" is an embodiment provided as an example, as opposed to necessarily being an embodiment of exemplary quality.

It should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

What is claimed is:

1. A method for altering a multi-channel soundfield representation of an audio environment, the multi-channel soundfield representation captured by a soundfield microphone, the method including the steps of:

(a) extracting a first audio component from the soundfield representation, the first audio component comprising audio activity incident from a range of angles in the multi-channel soundfield representation;

(b) determining a second audio component from the multi-channel soundfield representation, the second audio component corresponding to the multi-channel soundfield representation with the first component at least partly removed;

(c) inputting an auxiliary audio signal captured by an auxiliary microphone;

(d) mixing the auxiliary audio signal with the first audio component based on a comparison between an instantaneous signal to noise ratio, SNR, of the multi-channel soundfield representation and an instantaneous SNR of the auxiliary audio signal, and thereby forming a mixed audio component, (e) combining the second audio component with the mixed audio component to produce an output soundfield signal.

2. A method as claimed in claim 1 further comprising the step of delaying the second audio component relative to the mixed audio component before said combining step (e).

3. A method as claimed in claim 1 wherein said step (a) further includes isolating components of the second audio component in the first audio component by utilizing an adaptive filter that minimizes the perceived presence of the second audio component in the first audio component.

4. A method as claimed in claim 1 wherein said step (b) further includes isolating components of the first audio component in the second audio component utilizing an adaptive filter that minimizes the perceived presence of the first audio component in the second audio component.

5. A method as claimed in claim 1 wherein said soundfield includes a first order horizontal B-format representation.

6. An audio processing system for alteration of a multi-channel soundfield representation of an audio environment, the multi-channel soundfield representation captured by a soundfield microphone, the system including:

a first input unit for receiving the multi-channel soundfield representation;

an audio extraction unit for extracting a first audio component from the soundfield representation, the first component comprising audio activity incident from a range of angles in the multi-channel soundfield representation, and for determining a second audio component from the multi-channel soundfield representation, the second component corresponding to the multi-channel soundfield representation with the first component at least partly removed;

a second input unit for receiving an auxiliary audio signal captured by an auxiliary microphone;

a mixing unit for mixing the auxiliary audio signal with the first audio component based on a comparison between an instantaneous signal to noise ratio, SNR, of the multi-channel soundfield representation and an instantaneous SNR of the auxiliary audio signal, and thereby forming a mixed audio component;

a combining unit for combining the second audio component with the mixed audio component to produce an output soundfield signal.

7. A system as claimed in claim 6 further comprising a delay unit for delaying said second audio component relative to said mixed audio component before combining by said combining unit.

8. A system as claimed in claim 6 further comprising an adaptive filter for isolating components of the second audio component in the first audio component to minimize the perceived presence of the second audio component in the first audio component.

9. A system as claimed in claim 6, further comprising an adaptive filter for isolating components of the first audio component in the second audio component to minimizes the perceived presence of the first audio component in the second audio component.

* * * * *